United States Patent [19]

Ramos et al.

[11] 4,128,836

[45] Dec. 5, 1978

[54] TIME DELAY COMPUTER FOR ORDNANCE FUSE

[75] Inventors: Edward Ramos; Joseph V. Cuneo, both of Washington, D.C.

[73] Assignee: The United States of America as represented by the Secretary of the Army, Washington, D.C.

[21] Appl. No.: 62,804

[22] Filed: Oct. 14, 1960

[51] Int. Cl.[2] ..... G01S 9/04; F42C 13/04

[52] U.S. Cl. ..... 343/7 PF; 102/214

[58] Field of Search ..... 343/7, 7 PF; 102/70.2, 102/70.2 P, 214

[56] References Cited

U.S. PATENT DOCUMENTS

| | | | |
|---|---|---|---|
| 3,014,215 | 12/1961 | MacDonald | 343/7 PF |
| 3,043,222 | 7/1962 | Kaspaul | 343/7 PF |

*Primary Examiner*—T.H. Tubbesing
*Assistant Examiner*—Richard E. Berger
*Attorney, Agent, or Firm*—Nathan Edelberg; Robert P. Gibson; Saul Elbaum

EXEMPLARY CLAIM

1. In a missile having a fuse for detonating the missile warhead in the proximity of a target, means associated with said fuse for sensing the presence of a target, and means responsive to the sensing of a target by said sensing means for delaying the detonation of said warhead for an internally varied time interval until said missile is at an optimum position with respect to said target.

4 Claims, 3 Drawing Figures

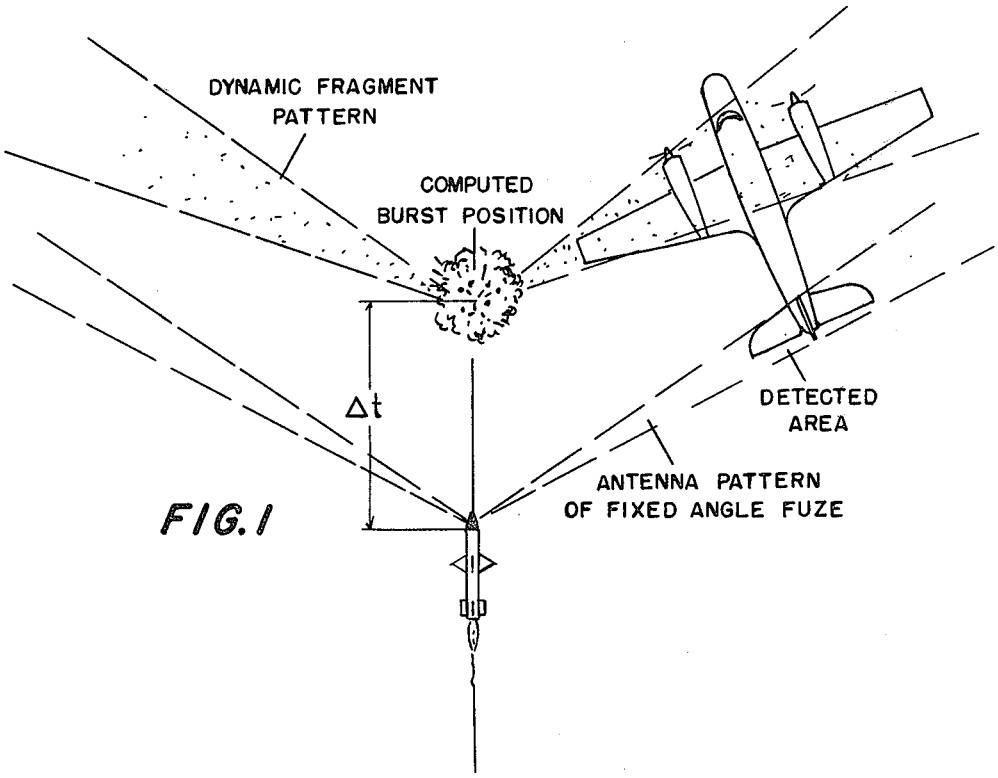
FIG. 1
FIG. 2
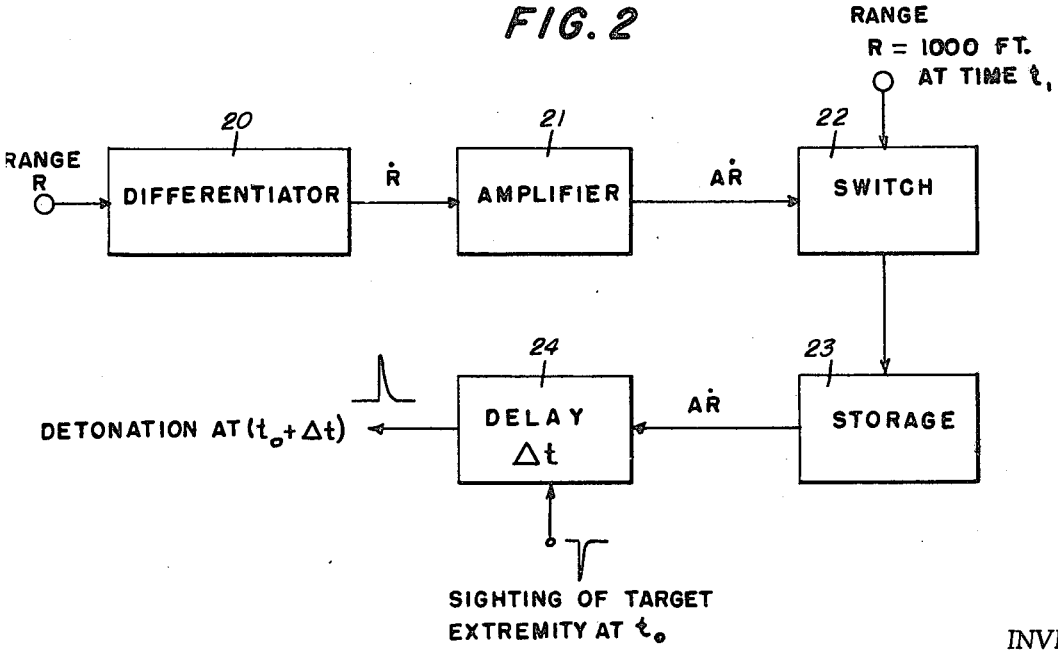
INVENTORS
EDWARD RAMOS
JOSEPH V. CUNEO
BY S. J. Rotondi, A. T. Dupont, F. E. McGee & J. P. Edwards INVENTORS
EDWARD RAMOS
JOSEPH V. CUNEO
BY S. J. Rotondi, A. J. Dupont, F. E. McGee & J. P. Edgerton

TIME DELAY COMPUTER FOR ORDNANCE FUSE

The invention described herein may be manufactured and used by or for the Government for governmental purposes without the payment to us of any royalty thereon.

This invention relates generally to fuzes for guided missiles and more particularly to a system for insuring the detonation of a missile at an optimum damage-causing position with respect to a target.

The vast majority of fuzes for guided missiles are of the type wherein a microwave antenna emits a conical radiation pattern at some fixed angle with respect to the missile. Detonation of the missile warhead occurs when a target, such an enemy airplane, intercepts the radiation pattern. Of course, such fuzes must be sensitive to an interception only within the destructive capability range of the warhead. It has been found, however, that the full destructive potentiality of the above described fuzes has not been realized, because the burst would usually occur at an extremity of the target, rather than at its most vulnerable sector, such as the fuselage-wing intersection. A complicating aspect of this problem is the fact that the missile can approach the target at a variety of attitudes and with any relative velocity so that no fixed time delay or the like can be utilized to effect a solution to the problem of most effectively detonating the warhead.

It is therefore an object of this invention to provide a system for detonating a missile when it is in a position to do the maximum damage to a target.

Other objects and advantages of this invention will be apparent from the following descriptive material including drawings wherein:

FIG. 1 illustrates a specific example of the utilization of the invention,

FIG. 2 is a block diagram of the invention, and

Figure 3:
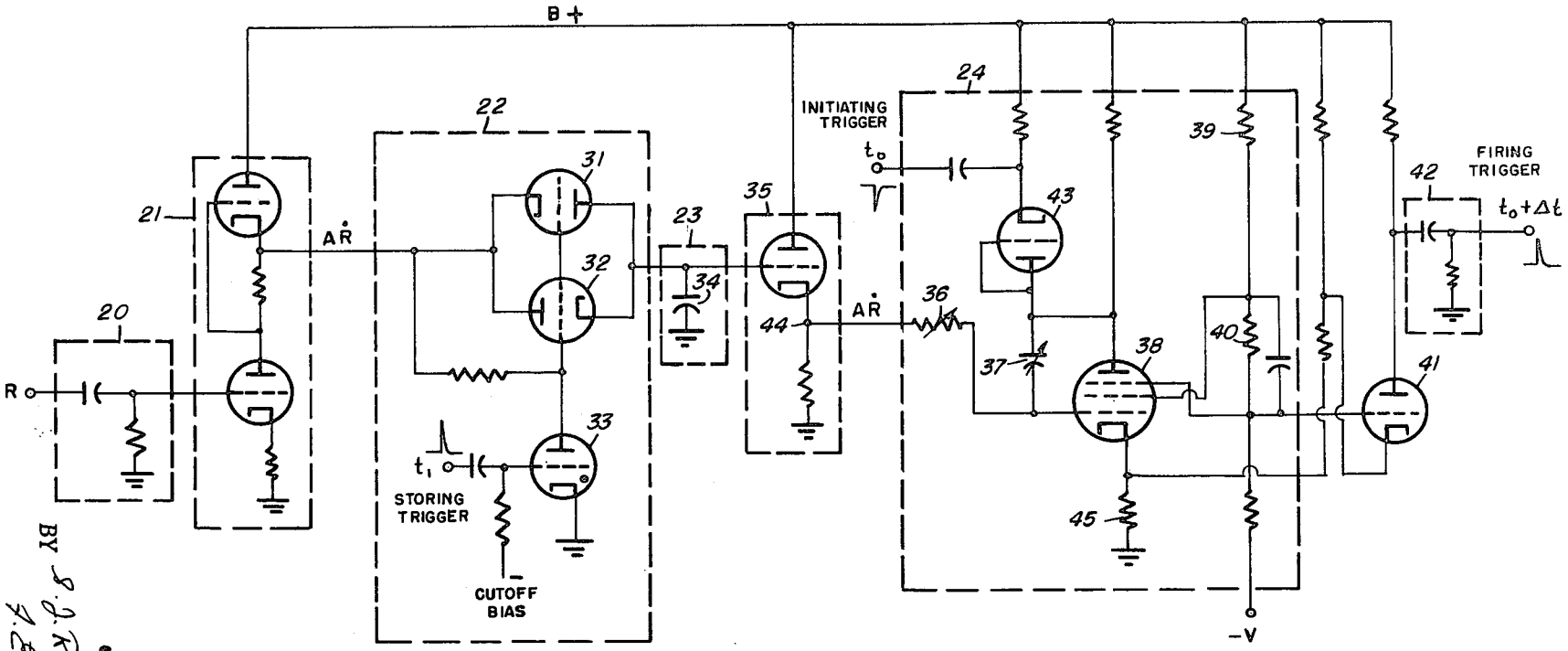
FIG. 3 illustrates specific circuitry which could be utilized for the components of FIG. 2.

Referring now to FIG. 1, there is shown an application of the invention to an anti-aircraft guided missile. It can be seen that if the missile warhead exploded when the antenna pattern first detected the aircraft, a minimum of damage would be done. However, at the computed burst position, the fragmentation pattern of the warhead fulfills its maximum destructive potential. Although the missile is shown approaching the target from the rear, this of course is only one of the possible approach attitudes which the missile could assume. If, for example, the missile and aircraft were heading toward each other, their relative velocities would be greater and the necessary time delay $\Delta t$ would perforce be smaller. It has been found that when the missile to target range is approximately 1000 feet, the relative velocity remains substantially constant until interception. The time delay computer of this invention therefore stores a voltage representative of relative velocity at a range of 1000 feet and when the target is first detected, initiates a time delay inversely proportional to the stored voltage – the warhead being detonated at the end of the time delay.

It is therefore a further object of this invention to provide a time delay inversely proportional to the relative velocity of two approaching vehicles.

In FIG. 2, a range voltage is obtained from conventional radar apparatus located either in a section of the missile removed from the fuze or at a ground control station. The range voltage R is fed into differentiator 20, resulting in a voltage $\dot{R}$ representative of the relative velocity of the missile with respect to the target. The voltage $\dot{R}$ is amplified in amplifier 21 and the output is fed into storage means 23 through normally closed switch 22. At time $t_1$, when the range is 1000 feet, a pulse is fed to switch 22, opening it and preventing any further velocity information from being applied to storage means 23. At time $t_0$, when the extremity of the target is sighted, the time delay $\Delta t$ inversely proportional to the stored voltage $A\dot{R}$ is initiated by a pulse applied to the delay means 24. At the termination of the delay period $\Delta t$ detonation occurs.

Referring now to FIG. 3, there is shown a specific circuit embodiment of the system described in connection with FIG. 2. The range voltage R is differentiated by differentiating circuit 20, a conventional RC network, the output of which is applied to the input of D.C. series amplifier 21. The amplified range rate voltage $A\dot{R}$ is applied to storage capacitor 34 through switch 22 consisting of triodes 31 and 32 and thyratron 33. In its closed state, switch 22 couples negative excursions of voltage $A\dot{R}$ through normally conducting triode 31 and positive excursions through normally conducting triode 32. At time $t_1$, when the range is approximately 1000 feet, a positive pulse is applied to the grid of normally nonconducting thyratron 33, causing it to conduct and consequently cutting off triodes 31 and 32. When the switch is thus opened, capacitor 34 is disconnected from amplifier 21 and is prevented from discharging. A large value of capacitance is required for capacitor 34 to minimize any possible discharge due to heater-cathode leakage in tube 32. Cathode follower circuit 35 is provided for isolating capacitor 34 from pentode 38 and the stored voltage $A\dot{R}$ will therefore appear at point 44.

The operation of time delay circuit 24 is similar to that of the well known phantastron circuit. In the standby condition, the control grid of pentode 38 draws current heavily through resistor 36, the other end of which is impressed with the control voltage $A\dot{R}$. The screen voltage is initially low due to large current flow through its dropping resistor 39 and consequently the suppressor which is coupled to the screen through resistor 40 will be held negative. Plate current will therefore be cut off and the plate will initially be at B+ potential. Triode 41, whose cathode is held slightly higher than the cathode of tube 38, has its grid tied to the suppressor grid of tube 38 and is consequently not drawing plate current.

The negative initiating trigger pulse received at time $t_0$ is coupled through diode 43 and capacitor 37 to the control grid of tube 38. This negative excursion of the grid momentarily reduces screen current, causing screen voltage to rise. The suppressor grid, coupled to the screen grid by resistor 40, also rises and plate current begins flowing. Increasing plate current causes a reduction in screen current due to the constant current nature of the pentode and screen voltage increases. This regenerative effect between the screen and plate speeds up the switching action. Since the control grid goes negative with respect to the cathode, it no longer draws current.

Timing capacitor 37 connected between the control grid and plate of pentode 38 provides feedback which tends to stabilize random variations of plate voltage. As capacitor 37, which had been initially charged up to B+, discharge through resistor 36 at an essentially constant rate, the plate voltage decreases at a linear rate describing a sawtooth. When the plate voltage "bottoms" or reaches the knee in the current characteristic of the pentode, the plate voltage rises quickly until it again reaches B+. It is the time between the commencement of plate current and the plate voltage "bottoming" which is utilized as the time delay. The greater the amplitude of the control voltage $A\dot{R}$ at point 44, the faster will be the rate at which the plate voltage decreases and the shorter will be the resultant time delay. Resistor 45 is selected to provide proper cathode bias conditions in order to insure linearity of the plate sweep. Thus, a time delay inversely proportional to relative velocity is provided.

During the delay interval, while the suppressor is positive, the plate voltage of tube 41 is relatively low since its grid is tied to the suppressor. At the end of the delay interval, when the plate voltage of tube 38 "bottoms," the suppressor will suddenly go negative. Consequently, the plate voltage of tube 41 will make a sudden positive jump. This signal is differentiated in resistance-capacitance network 42 to produce the firing pulse.

Although one specific embodiment of the invention has been described, it should be apparent that various modifications are possible. For example, resistor 36 and capacitor 37 can be made variable to provide an adjustable time constant in order to compensate for the variance in size among targets. The adjustment would be made before launching the missile.

We claim as our invention:

1. In a missile having a fuze for detonating the missile warhead in the proximity of a target, means associated with said fuze for sensing the presence of a target, and means responsive to the sensing of a target by said sensing means for delaying the detonation of said warhead for an internally varied time interval until said missile is at an optimum position with respect to said target.

2. In a fixed angle fuze, a computer for determining the optimum time for detonating said fuze in the presence of a target comprising means providing a voltage indicative of the relative velocity of said fuze with respect to said target, means connected to the output of said voltage providing means for storing said voltage when said fuze is at a predetermined distance from said target, means connected to said storage means so as to be controlled by said stored voltage for initiating a time delay inversely proportional to said stored voltage when said fuze detects said target, and means connected to said time delay means for producing a detonation pulse at the end of said time delay.

3. In a fixed angle fuze for detonating an associated missile warhead in the proximity of a target, means for continuously supplying range voltage information to said fuze, means connected to said range voltage supplying means for converting said range voltage information to a voltage representative of the velocity of said missile relative to said target, storage means responsive to the output of said converting means for storing said relative velocity voltage, switch means connected between said converting means and said storage means for disconnecting said converting means from said storage means when the missile is at a predetermined distance from said target, detecting means for detecting the proximity of said target, means responsive to the detection of the target by said detecting means for providing a detonation pulse, and means connected to said means providing a detonation pulse and to said storage means for delaying said detonation pulse for a time inversely proportional to said stored voltage.

4. The invention of claim 3 wherein said delay means additionally comprises means for adjusting said delaying means in accordance with the size of said target.

* * * * *